US011254463B1

(12) United States Patent
Kissinger et al.

(10) Patent No.: US 11,254,463 B1
(45) Date of Patent: Feb. 22, 2022

(54) NON-ROUND PLASTIC CONTAINER WITH STRUCTURAL FEATURES

(71) Applicant: Plastipak Packaging, Inc., Plymouth, MI (US)

(72) Inventors: Jeffrey Kissinger, Wadsworth, OH (US); James C. Dorn, Sterling, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 15/802,912

(22) Filed: Nov. 3, 2017

Related U.S. Application Data

(60) Provisional application No. 62/417,074, filed on Nov. 3, 2016.

(51) Int. Cl.
*B65D 1/44* (2006.01)
*B65D 1/16* (2006.01)

(52) U.S. Cl.
CPC ..... *B65D 1/44* (2013.01); *B65D 1/16* (2013.01)

(58) Field of Classification Search
CPC ..... B65D 1/10; B65D 21/0201; B65D 11/24; B65D 21/0204; B65D 11/20; B32B 1/02
USPC ..... 220/672, 646, 669, 781, 660, 4.22, 671, 220/675, 254.3; 215/383, 343, 382, 40, 215/43; 206/508; 383/203
See application file for complete search history.

(56) References Cited

U.S. PATENT DOCUMENTS 5,005,716 A * 4/1991 Eberle ..... B65D 1/0276 215/373
6,889,866 B2 * 5/2005 Gilliam ..... B65D 1/10 215/383
7,520,399 B2 * 4/2009 Lane ..... B65D 1/0223 206/509
7,694,845 B2 * 4/2010 Tilton ..... B65D 51/20 220/799
7,874,442 B2 * 1/2011 Nievierowski ..... B65D 79/005 215/384
8,025,176 B2 * 9/2011 Little ..... B65D 25/2897 220/675
8,042,704 B2 * 10/2011 Borowski ..... G01F 19/002 220/574.1
8,469,223 B2 * 6/2013 Perry ..... B65D 79/005 220/608
D743,267 S * 11/2015 Rathbone ..... D9/543
9,387,963 B2 * 7/2016 McBroom ..... B65D 45/22
(Continued)

*Primary Examiner* — J. Gregory Pickett
*Assistant Examiner* — Tia Cox
(74) *Attorney, Agent, or Firm* — Fishman Stewart PLLC

(57) ABSTRACT

A non-round plastic container includes an upper portion, a sidewall portion, and a base portion. The upper portion includes an opening and the sidewall portion extends downwardly from the upper portion, and the base portion extends downwardly from the sidewall portion. In embodiments, the sidewall portion includes a front surface, a rear surface, and opposing side surfaces disposed between the front surface and the rear surface, and the front surface, rear surface, and opposing side surfaces each include a flat configured to contact a flat on an opposing surface associated with a similar container. In embodiments, the opposing sides may have a substantially straight or a curved/tapered configurations, and/or one or more surface of the container may include one or more reinforcing formations. In embodiments, the container has a substantially oval or ovaloid shape.

19 Claims, 15 Drawing Sheets

(56) References Cited

U.S. PATENT DOCUMENTS

| | | | | |
|---|---|---|---|---|
| 9,511,890 | B2 * | 12/2016 | Gill | B65D 1/10 |
| D850,265 | S * | 6/2019 | Robling | D9/516 |
| 2003/0010743 | A1 * | 1/2003 | Boukobza | B65D 1/0223 215/382 |
| 2005/0045645 | A1 * | 3/2005 | Tsutsui | B65D 79/005 220/669 |
| 2008/0093332 | A1 * | 4/2008 | Little | B65D 23/102 215/384 |
| 2009/0321386 | A1 * | 12/2009 | Lane | B65D 23/102 215/384 |
| 2011/0174829 | A1 * | 7/2011 | Yourist | B65D 1/0223 220/669 |

* cited by examiner

NON-ROUND PLASTIC CONTAINER WITH STRUCTURAL FEATURES

CROSS-REFERENCE TO RELATED APPLICATION

The application claims the benefit of U.S. Provisional Patent Application Ser. No. 62/417,074, filed on Nov. 3, 2016, the disclosure of which is hereby incorporated herein by reference in its entirety.

TECHNICAL FIELD

The present disclosure relates generally to non-round plastic containers, including extrusion-molded, non-round plastic containers with structural features.

BACKGROUND

Various types of plastic containers are known in the art, including extrusion-molded containers.

Among other things, it can be desirable to provide non-round plastic containers that include features providing various advantages.

SUMMARY

A non-round plastic container including an upper portion, a sidewall portion, and a base portion. The upper portion includes an opening and the sidewall portion extends downwardly from the upper portion, and the base portion extends downwardly from the sidewall portion. In embodiments, the sidewall portion includes a front surface, a rear surface, and opposing side surfaces disposed between the front surface and the rear surface, and the front surface, rear surface, and opposing side surfaces each include a flat configured to contact a flat on an opposing surface associated with a similar container. In embodiments, the opposing sides may have a substantially straight or a curved/tapered configurations, and/or one or more surface of the container may include one or more reinforcing formations. In embodiments, the container has a substantially oval or ovaloid shape.

Various aspects of the present disclosure will become apparent to those skilled in the art from the following detailed description of the various embodiments, when read in light of the accompanying drawings.

DETAILED DESCRIPTION

Reference will now be made in detail to embodiments of the present disclosure, examples of which may be described herein and illustrated in the included representations and drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
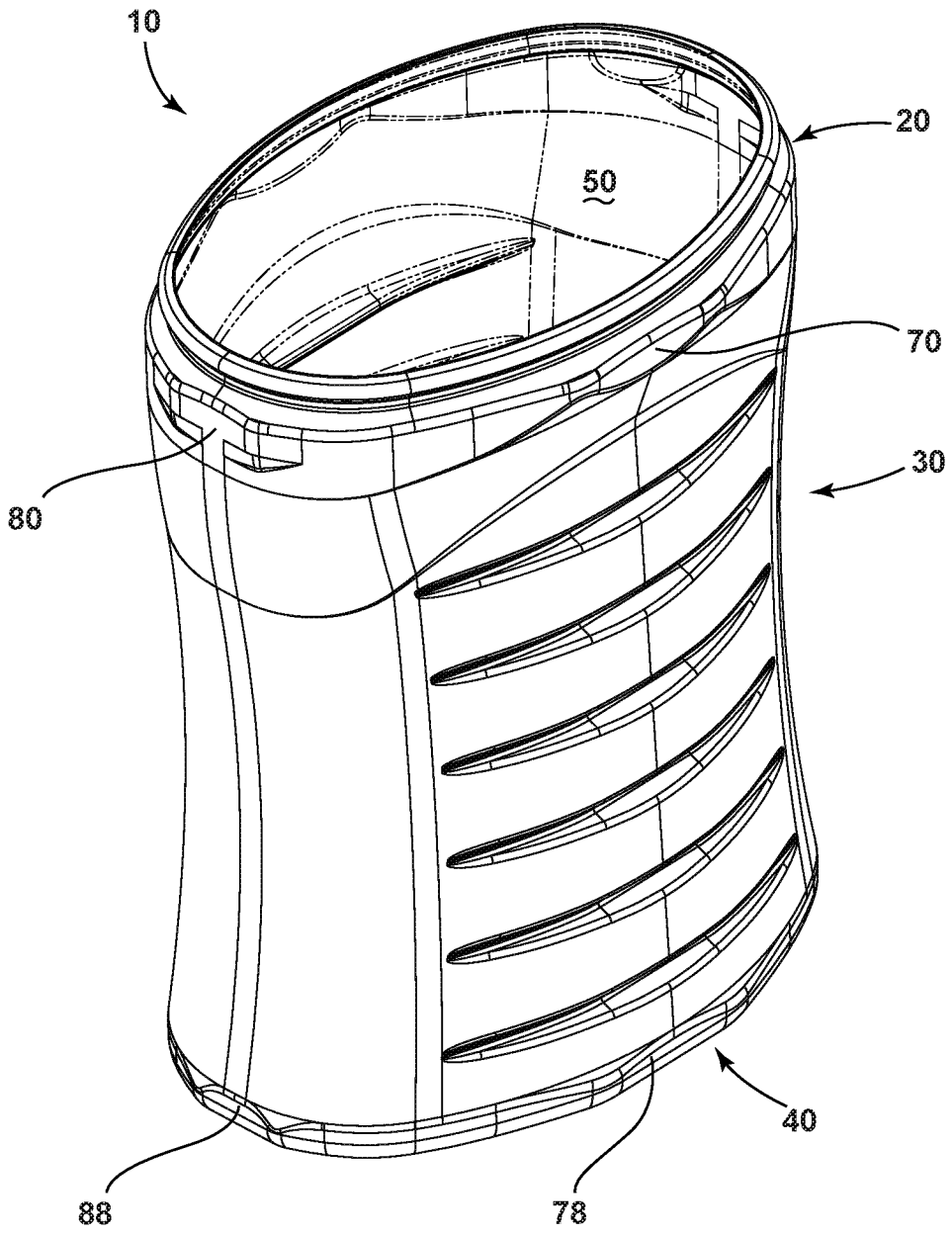
FIG. 1 is a top-front-side perspective view of an embodiment of a container embodying aspects of the present disclosure.
Figure 2:
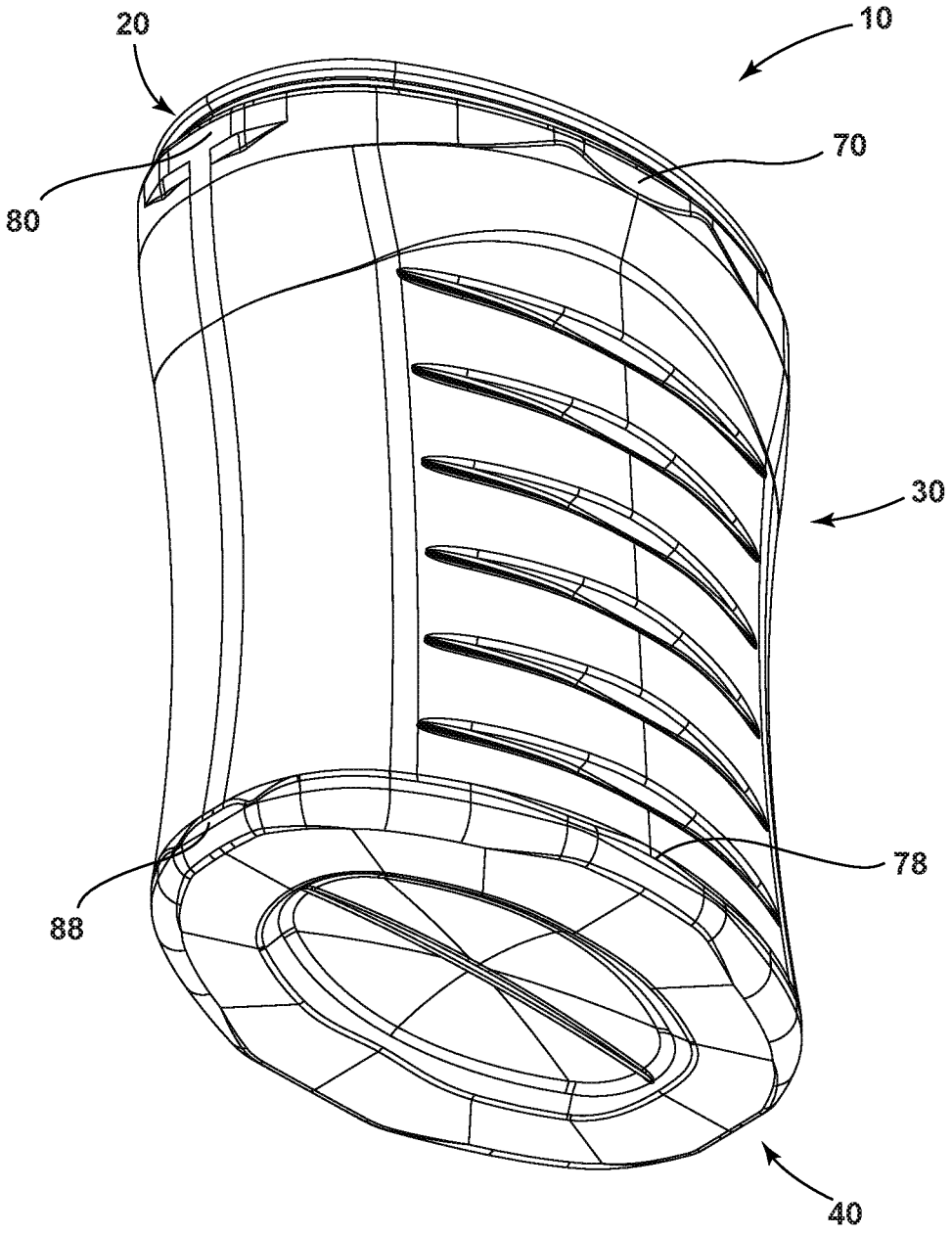
FIG. 2 is a bottom-front-side perspective view of the container illustrated in FIG. 1.

An embodiment of a container 10 embodying aspects/features of the present disclosure is generally illustrated in FIGS. 1 and 2. As generally shown, container 10 may include an upper portion (or ridge portion) 20, a sidewall portion 30, and a base portion 40. As generally illustrated the upper portion may, in part, define an opening 50. In embodiments, the upper portion 20 may define an opening that has a non-circular shape—e.g., an oval or ovaloid shape, such as generally depicted. In embodiments, a sidewall portion may generally include a front surface (associated with a front elevation view, see, e.g., FIG. 3), a rear surface (which may be a mirror image of the front surface), and opposing side surfaces (see, e.g., FIG. 4) that are disposed between the front surface and the rear surface.

Figure 3:
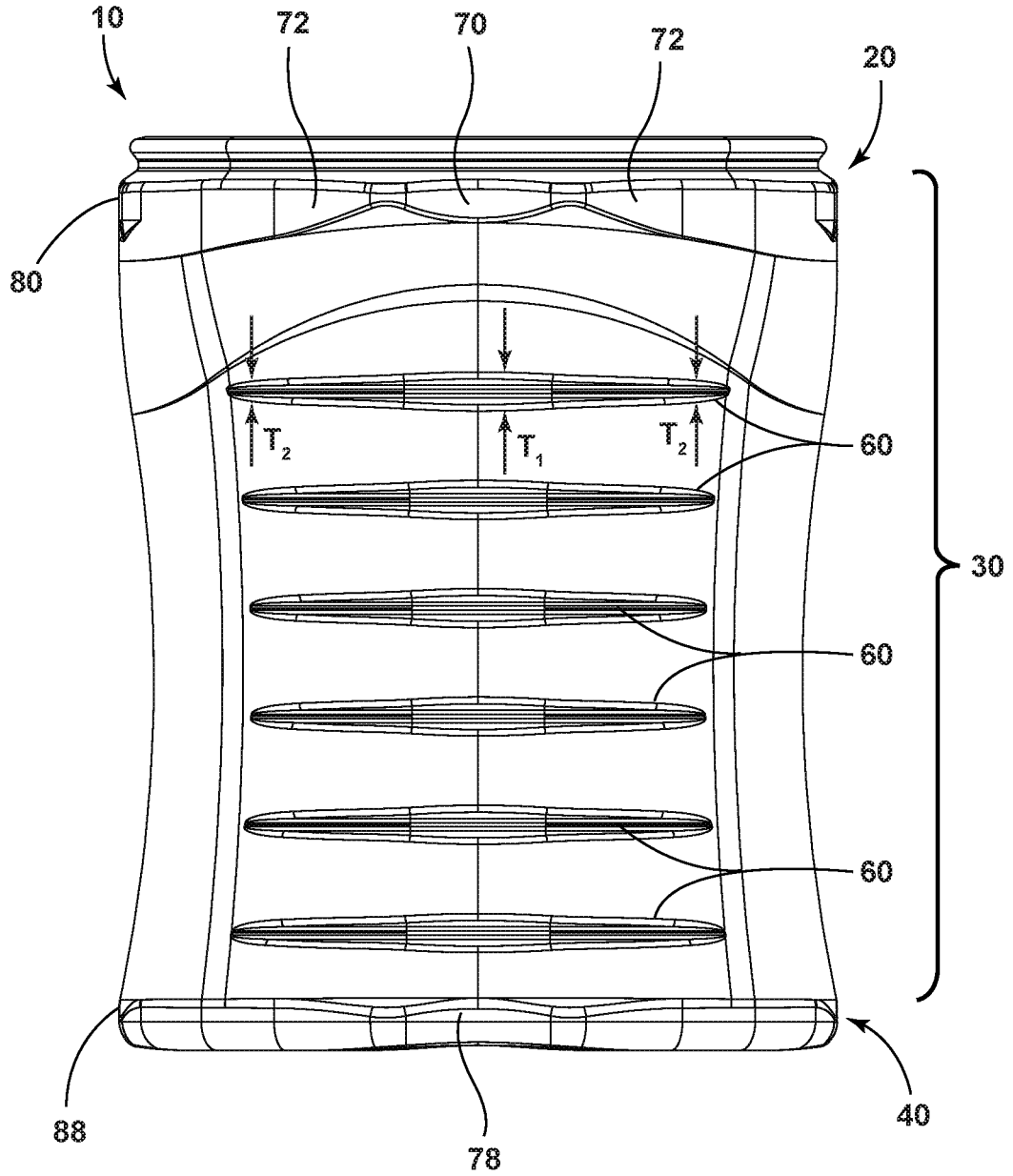
FIG. 3 is a front elevation view of the container illustrated in FIG. 1.

FIG. 3 generally illustrates a front elevation view of the container 10 illustrated in FIGS. 1 and 2. In embodiments, such as generally illustrated, the sidewall portion 30 of the container 10 may have a curved or shaped contour. Such a contour may, inter alia, be configured to facilitate gripping by an intended user. For example, as illustrated in FIG. 3, the sidewall may have a portion at a position just below the upper portion 20 that moves or tapers inwardly, and then, at some point (e.g., at or about the vertical mid-point for the container), moves or tapers back outwardly as the sidewall portion 30 approaches the base portion 40.

The container 10 may include one or more reinforcing formations provided in the sidewall portion 30. In the embodiment illustrated, the reinforcing formations may comprise one or more horizontally-extending ribs 60. As illustrated, a plurality of reinforcing formations (which may take the form of the plurality of ribs 60) may be disposed at a number of vertical positions in the sidewall portion 30. Such reinforcing formations may be provided at several vertical positions with respect to the container 10 and may provide an added/desired measure of structural reinforcement to the container.

In embodiments, one or more of the ribs 60 may, as generally shown, have varying vertical dimensions. For example only, and with reference to FIG. 3, an inwardly-extending horizontal rib 60 may have a vertical thickness $T_1$ at or adjacent to a centerline or middle position (with respect to the front view), with the rib 60 tapering in each direction toward respective ends of such rib (e.g. tapering to a comparatively smaller thickness at, for example, a position $T_2$). For example, and without limitation, the greatest vertical thickness (viewed in side elevation) may be at or about $T_1$, and that vertical thickness may, for example and without limitation, be nearly twice the vertical thickness measurement taken at or about $T_2$.

Figure 4:
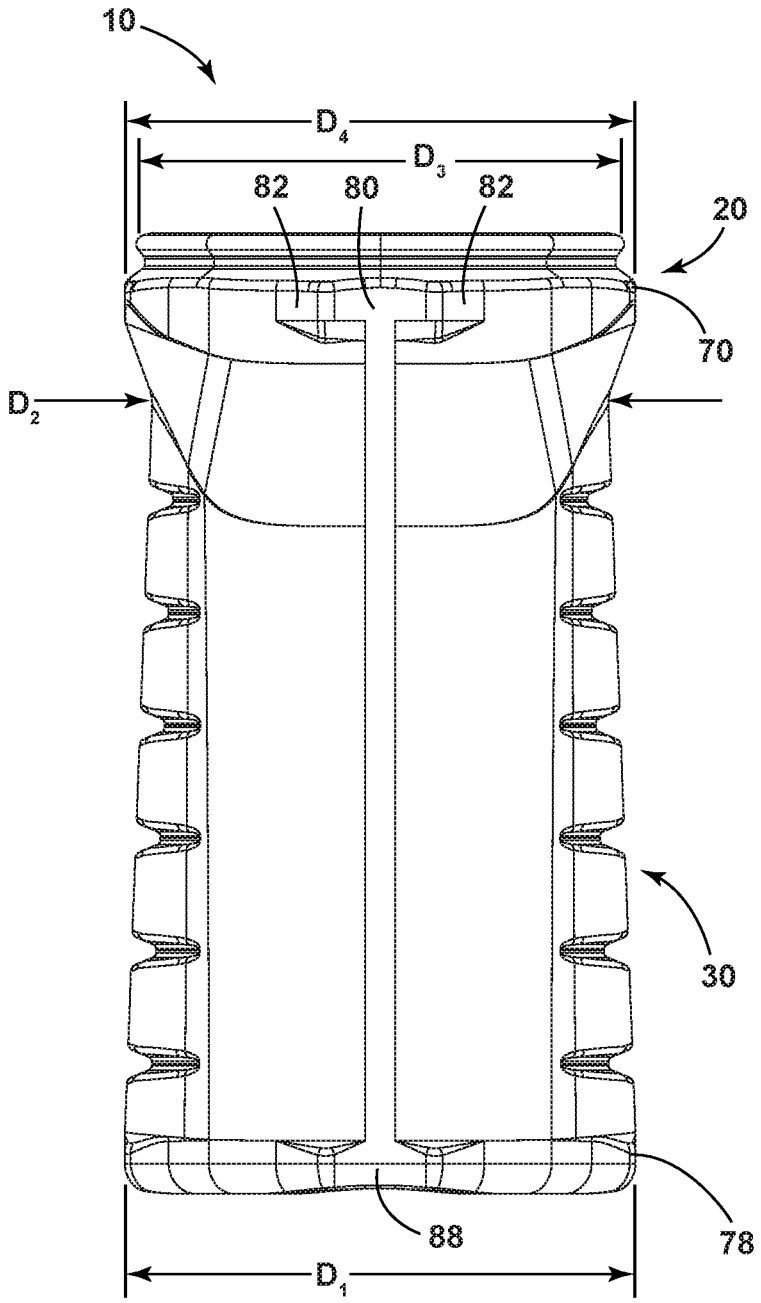
FIG. 4 is a side elevation view of the container illustrated in FIG. 1.

FIG. 4 generally illustrates a side elevation view of the container shown in FIGS. 1 and 2. As generally depicted, the container may have a depth/dimension (i.e., dimension measured horizontally across in the side view) that varies at different vertical positions. For example, the sidewall portion 30 may have a depth $D_1$ at or about the base portion 40 (e.g., at or about element 78), and a depth $D_2$ at or about the position indicated under the upper portion 20, which may be the least depth in the sidewall portion 30 of the container. In embodiments, the depth may increase (e.g., taper outwardly) from the vertical position associated with $D_2$ to the position associated with $D_1$. Additionally with continued reference to FIG. 4, in embodiments the uppermost portion of the container, which is associated with the opening 50, may have a depth $D_3$ and a dimension from the outer extents of 70 may have a depth $D_4$. In embodiments, and as generally illustrated, depth $D_4$ is greater than depth $D_3$, and/or depth $D_4$ may be approximately equal to depth $D_1$.

Additionally, as generally shown in FIGS. 1-6, the sidewall portion 30 of the container may include flat portions (or "touch points") on one or more "sides" (or drawing views). For example, without limitation, the front side and/or corresponding rear side (which may generally be a mirror image of the front side/view) may include one or more flat portion(s) (e.g., flats 70 and 78). Similarly, the "side view" sides, in which opposite side views may generally be mirror images of one another, may include one or more flat portion(s) (e.g., flats 80 and 88). As shown in the illustrated embodiments, flats may be included on each side of the container, with a flat on each side being positioned in an upper portion of the sidewall portion 30 (e.g., flats 70 and 80) and a flat being positioned in the base portion 40 (e.g., 78 and 88). The flat portion(s) may be flat or substantially flat or planar, and may as such facilitate contact with a similar portion of a similar adjacent container. Such flat portions (or touch points) are generally provided at outermost extending positions (in the respective views), such that the relevant flats or touch points would generally be the first points of contact with respect to an identical container provided adjacent thereto with a similar orientation (see, e.g., FIGS. 9, 10A, and 10B). Moreover, as generally illustrated in FIGS. 3 and 4, upper and lower flats on a respective "side" (i.e., flats 70 and 78 on a front/rear side, or flats 80 and 88 on a left/right side) may generally extend outwardly to approximately the same outermost point or vertical plane in space. Consequently, while the containers may have an ovaloid or oval shape with substantially curved sides and portions thereof, such flat portions in the sides can be configured to generally match up with corresponding flat portions on similar containers. Such a match up can, among other things, resist undesirable turning in connection with packaging, transport, or conveyance of containers, particularly those that may come into some measure or form of contact.

Figure 5:
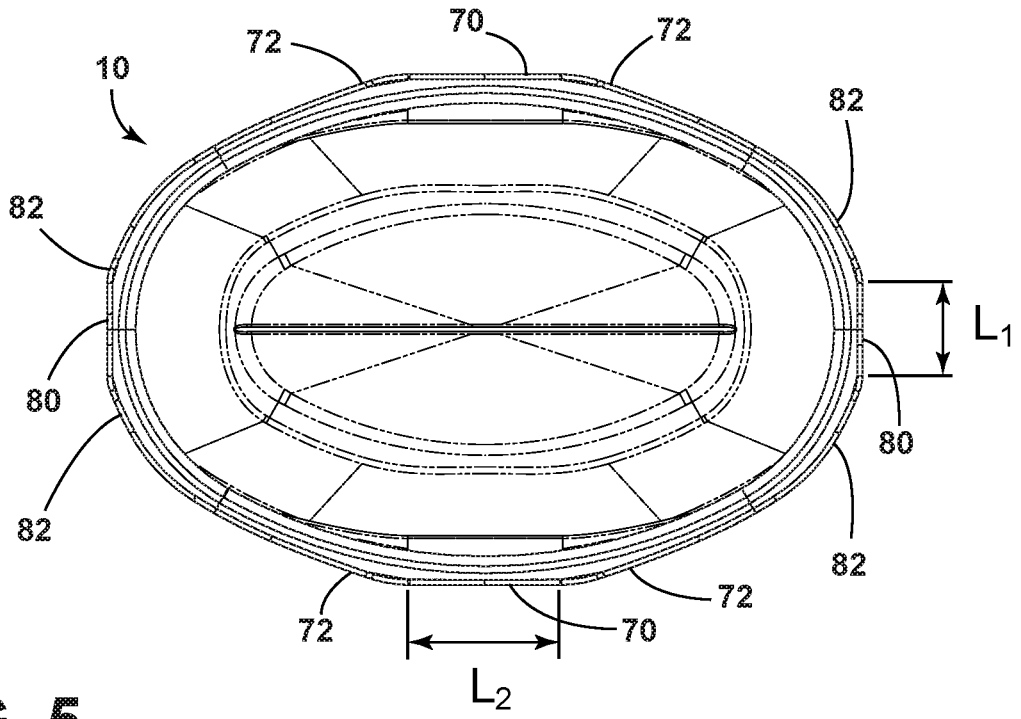
FIG. 5 is a top plan view of the container illustrated in FIG. 1.

While containers can encounter different internal (e.g., due to contents) and/or external pressures (e.g., pressures at altitude when shipping), the containers may be configured to include reinforcing formations or other structural formations to resist undesirable deformation in certain portions or positions. The containers may be configured so that the flat portions particularly remain consistent under normal conditions. For example and without limitation, the flats may be disposed adjacent or in proximity to structural features such as front/rear formation/surfaces 72 (see, e.g., FIGS. 3 and 5) or side formation/surfaces 82 (see, e.g., FIGS. 4 and 5). Similar corresponding structural features may, be included with flats (e.g., 78, 88) provided in the base portion 40 of the container. As generally illustrated in FIG. 5, a flat associated with a side formation surface (irrespective of whether upper or lower) may have a length (viewed in top plan) of $L_1$ and a flat associated with a front/rear formation may have a length (viewed in top plan) of $L_2$. In embodiments in which a plastic container includes flats in both front/rear and opposing sides, $L_2$ may be greater than $L_1$. For example and without limitation, in embodiments $L_1$ may be less than 0.75 $L_2$, or even less than 0.60 $L_2$. In other embodiments, $L_1$ and $L_2$ may be the same or substantially equal.

Figure 6:
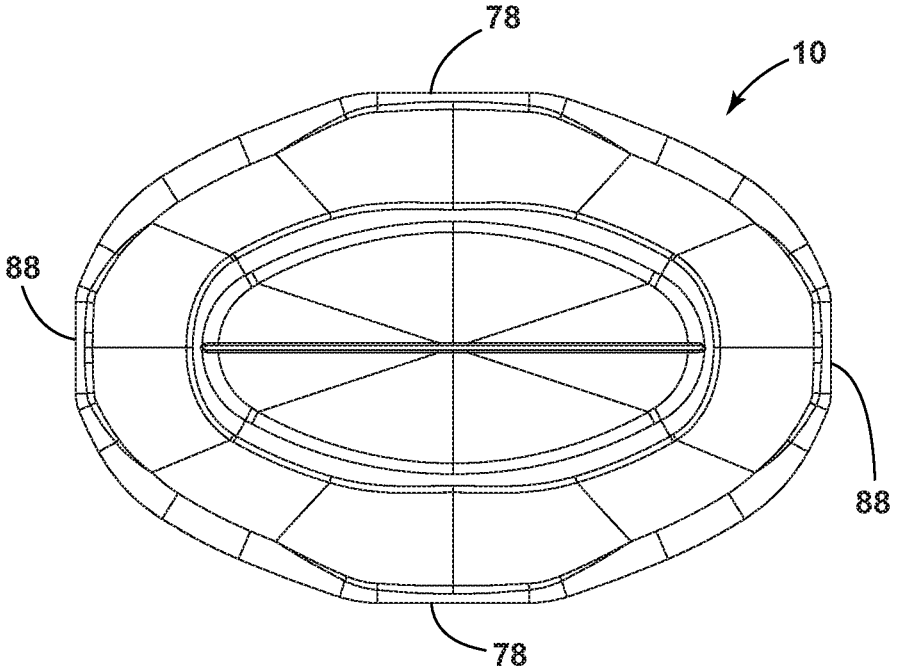
FIG. 6 is a bottom view of the container illustrated in FIG. 1.
Figure 7:
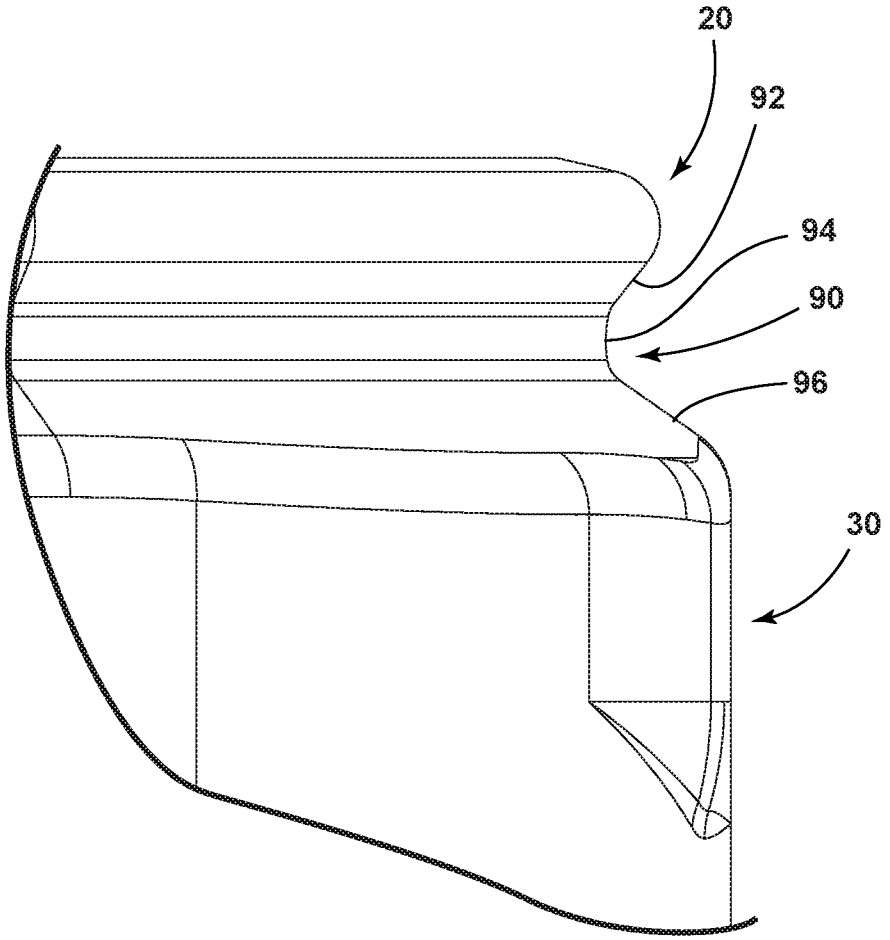
FIG. 7 is an enlarged view of a portion of the container indicated in FIG. 1.

The top plan and bottom views included in FIGS. 5 and 6 generally illustrate the non-round shape of the container, with the exemplary opening 50 shown having a substantially ovaloid shape. FIG. 7 shows an enlarged view of the portion of an embodiment of a container 10, and illustrates an embodiment with a configuration/interaction between the upper portion 20 and the sidewall portion 30. As generally shown, there can be an annular band (or ring) 90 that is part of the upper portion 20 and transitions into the sidewall portion 30. The annular band 90 may include an upper angled segment 92, a substantially vertical segment 94, and a lower angled segment 96.

For example and without limitation, the plastic container (and dome) may be comprised of a polymer such as high density polyethylene (HDPE) or polypropylene (PP). However, the concept is not necessarily limited to the disclosed polymers, and other suitable polymers may be utilized. Moreover, embodiments of containers may be monolayer or multilayer.

Figure 8:
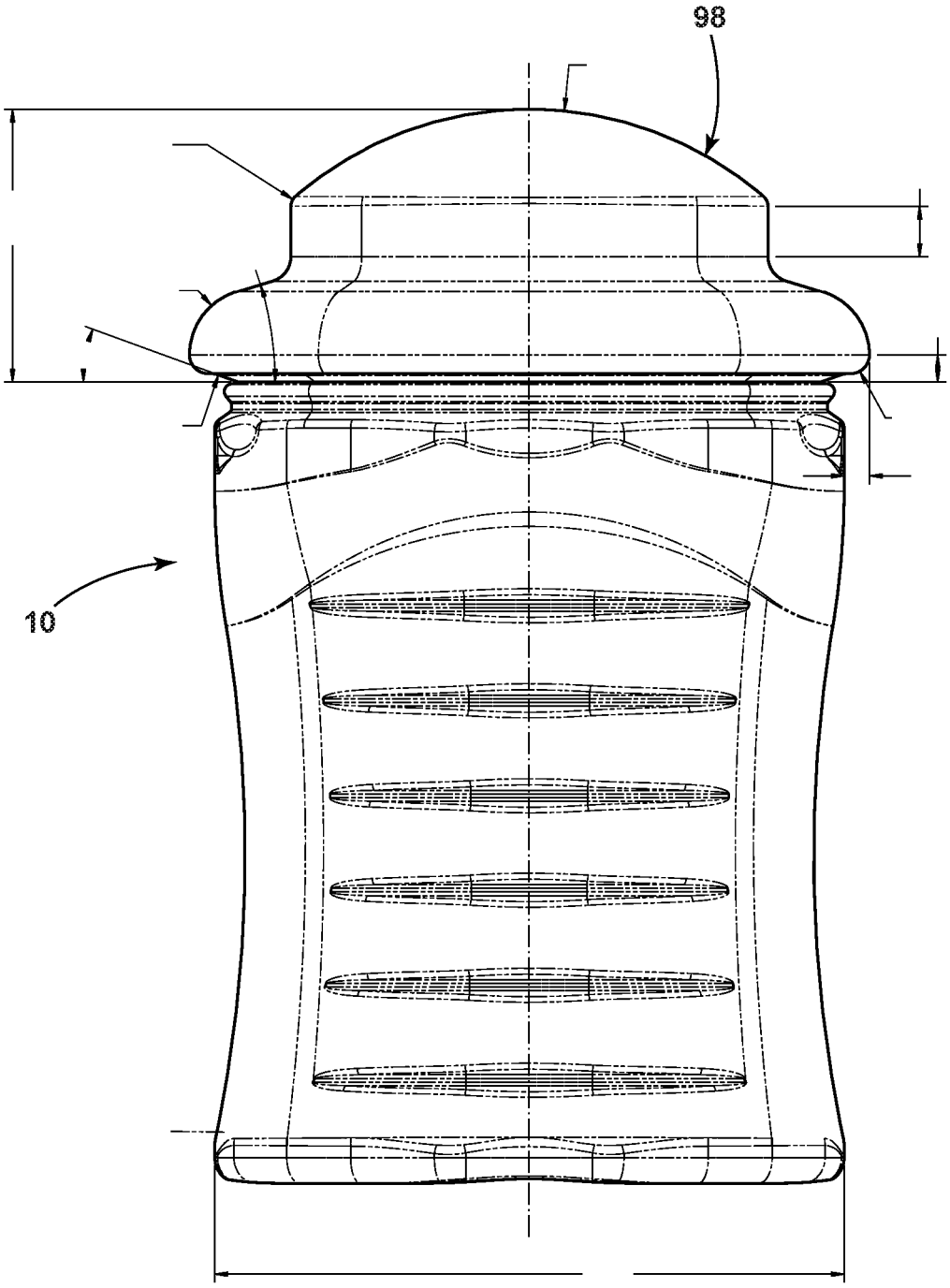
FIG. 8 is a front elevation view of an embodiment of a container, similar to the container generally illustrated in FIG. 3 and including a blow dome.

In embodiments, the container may be formed via extrusion molding or extrusion blow molding. Such molding may involve, for example, a rotary wheel or a shuttle. With reference to FIG. 8, which generally illustrate embodiments of a container of the type shown in FIG. 3 and including a dome 98 (which may also be referred to as a "blow dome" or "moil"). In embodiments, the container, with a dome, may be formed by extrusion molding or extrusion blow molding. In a subsequent step, the dome may be trimmed or otherwise removed, leaving the desired container. The trimmed/removed dome may then be reground and/or recycled.

FIGS. 11-17 generally illustrate corresponding views of an alternate container embodiments that include elements/features similar to those depicted in FIGS. 1-7. However, among other things, the embodiment in the figures may employ different dimensions (e.g., depths in side view), and/or comparative ratios. For example and without limitation, the sidewall portion 30 associated with the container illustrated in FIGS. 11-17 A may include a substantially vertical sidewall (see, e.g., FIG. 13)—which may be contrasted with the curve associated with the sidewall portion 30 illustrated in the embodiment depicted in FIG. 3. However, while two embodiments with general configurations are shown, numerous variations concerning the containers—e.g., height, length, width may be modified.

Figure 9:
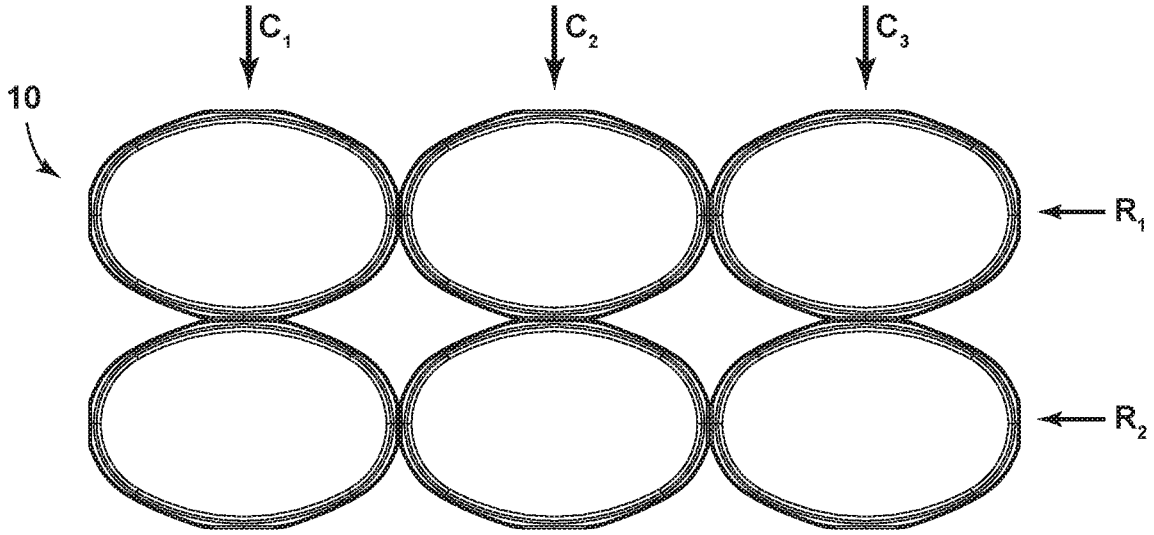
FIG. 9 is top plan view generally illustrating a plurality of containers arranged in a configuration in rows and columns.
Figure 18:
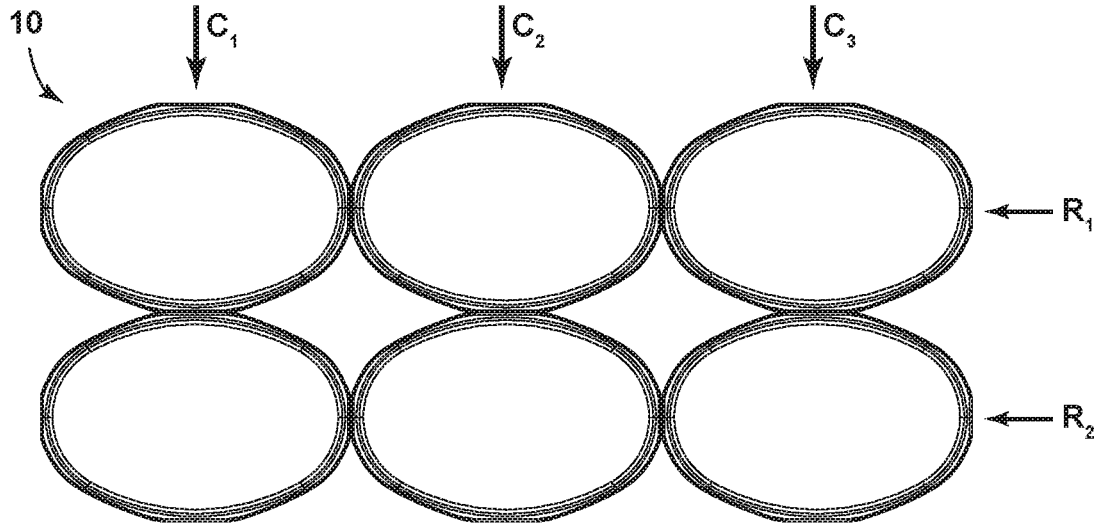
FIG. 18 is top plan view of a plurality of containers arranged in a configuration in rows and columns.
Figure 19:
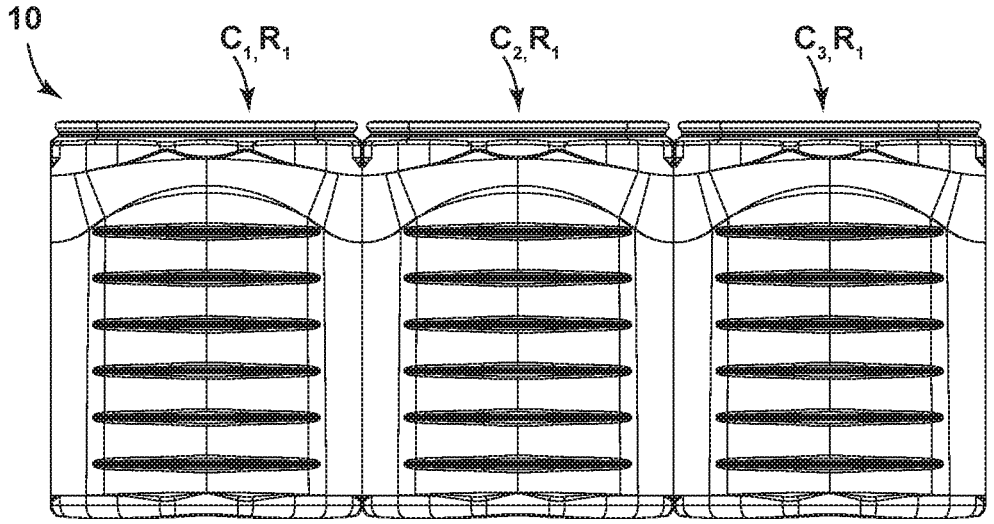
FIG. 19 is front elevation view generally illustrating a plurality of containers of the type shown in FIG. 13, the containers arranged in a side-by-side configuration.

As generally illustrated in FIGS. 9 and 18, a plurality of containers embodying aspects or teachings of the present disclosure may be arranged in a configuration comprising one or more rows (e.g., $R_1$, $R_2$ . . . $R_N$ and/or one or more columns (e.g., $C_1$, $C_2$, $C_3$, . . . $C_N$).

Figure 10A:
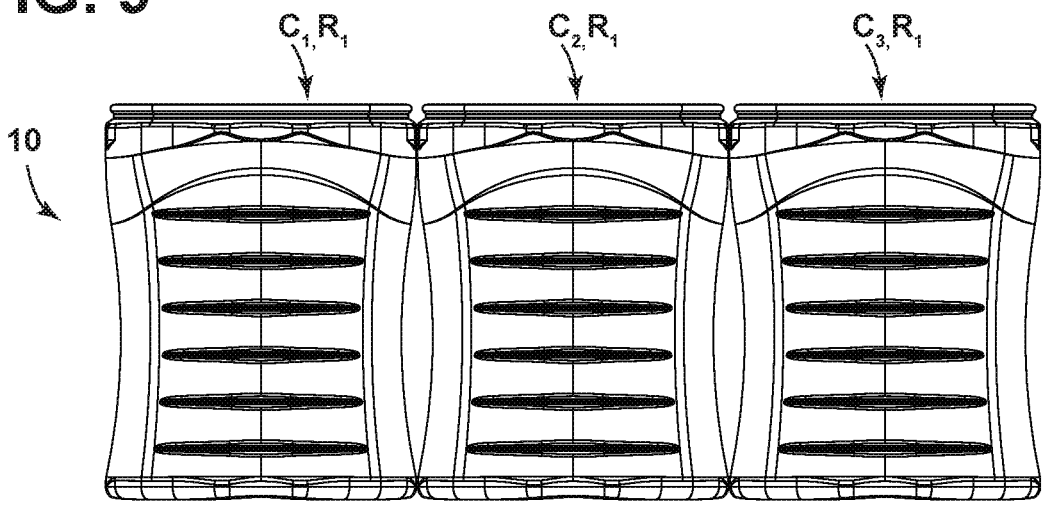
FIG. 10A is front elevation view generally illustrating a plurality of containers of the type shown in FIG. 3, the containers arranged in a side-by-side configuration.
Figure 10B:
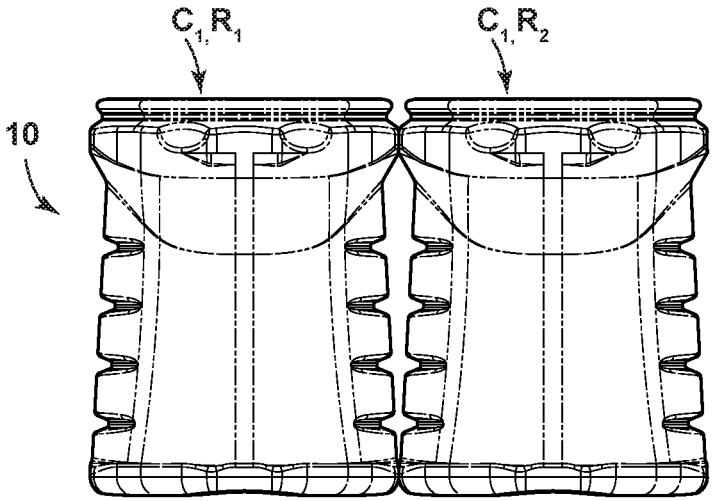
FIG. 10B is side elevation view generally illustrating a plurality of containers similar to the type shown in FIG. 3, the containers arranged in a side-by-side configuration.
Figure 11:
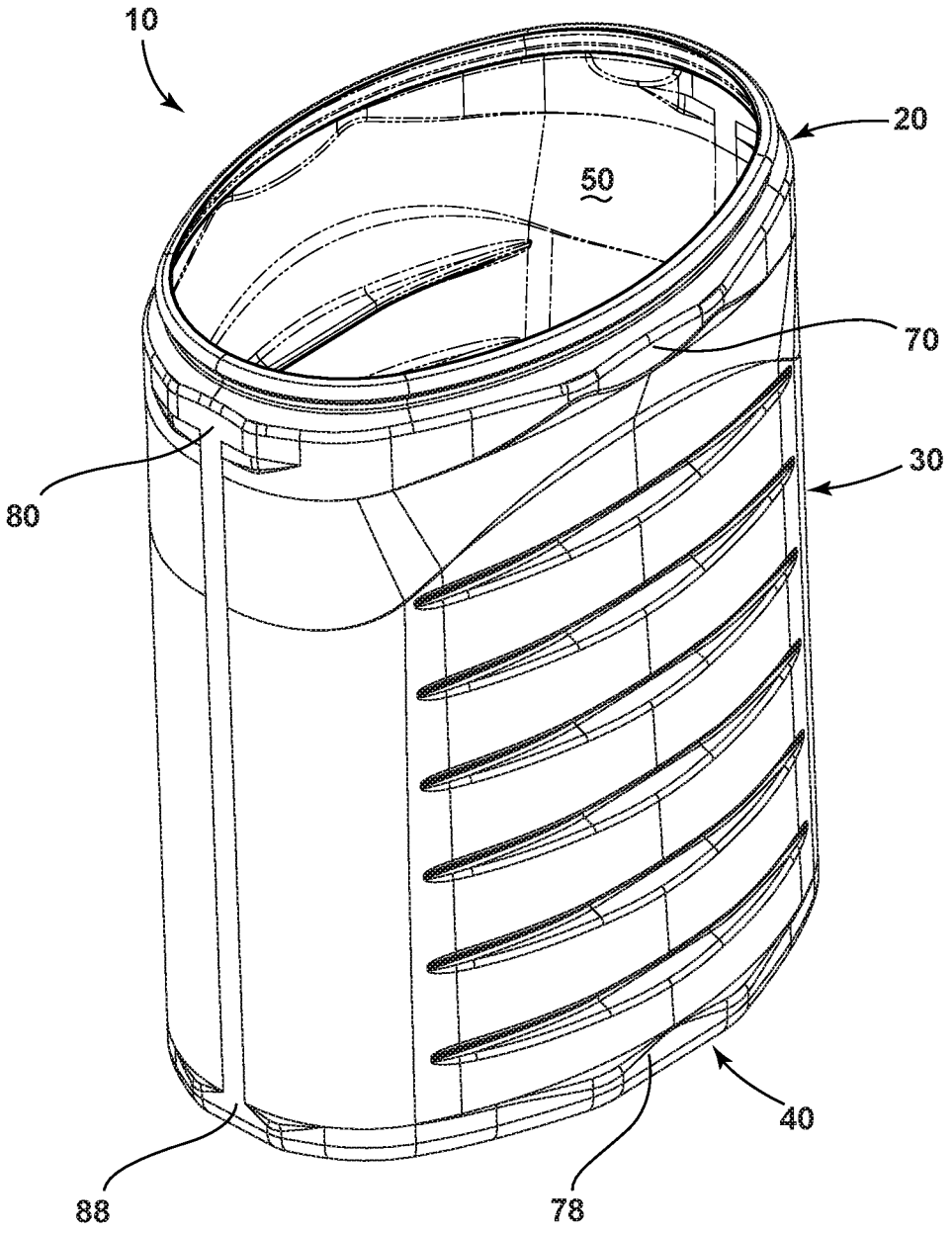
FIG. 11 is a top-front-side perspective view of an embodiment of a container embodying aspects of the present disclosure.
Figure 12:
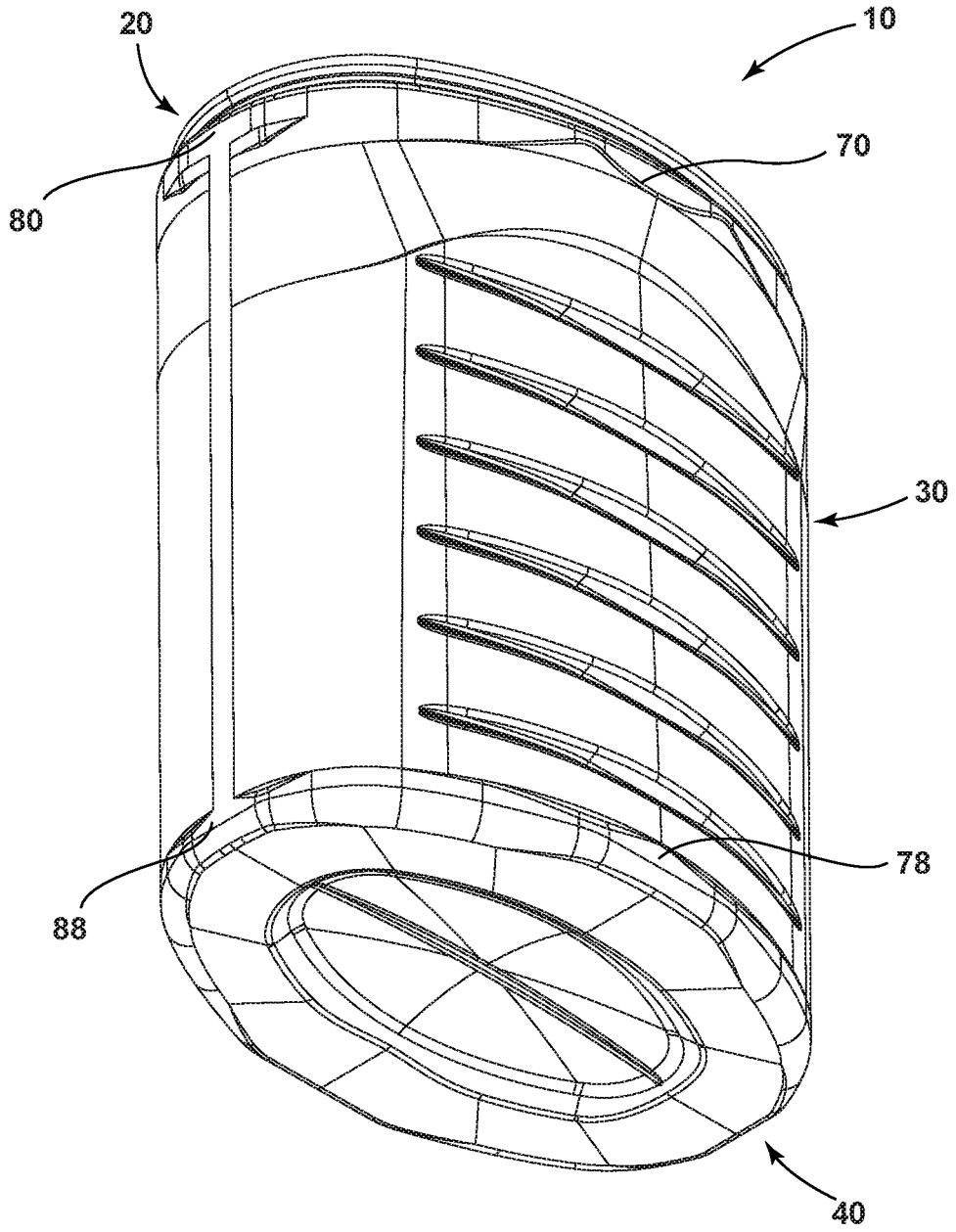
FIG. 12 is a bottom-front-side perspective view of the container illustrated in FIG. 11.
Figure 13:
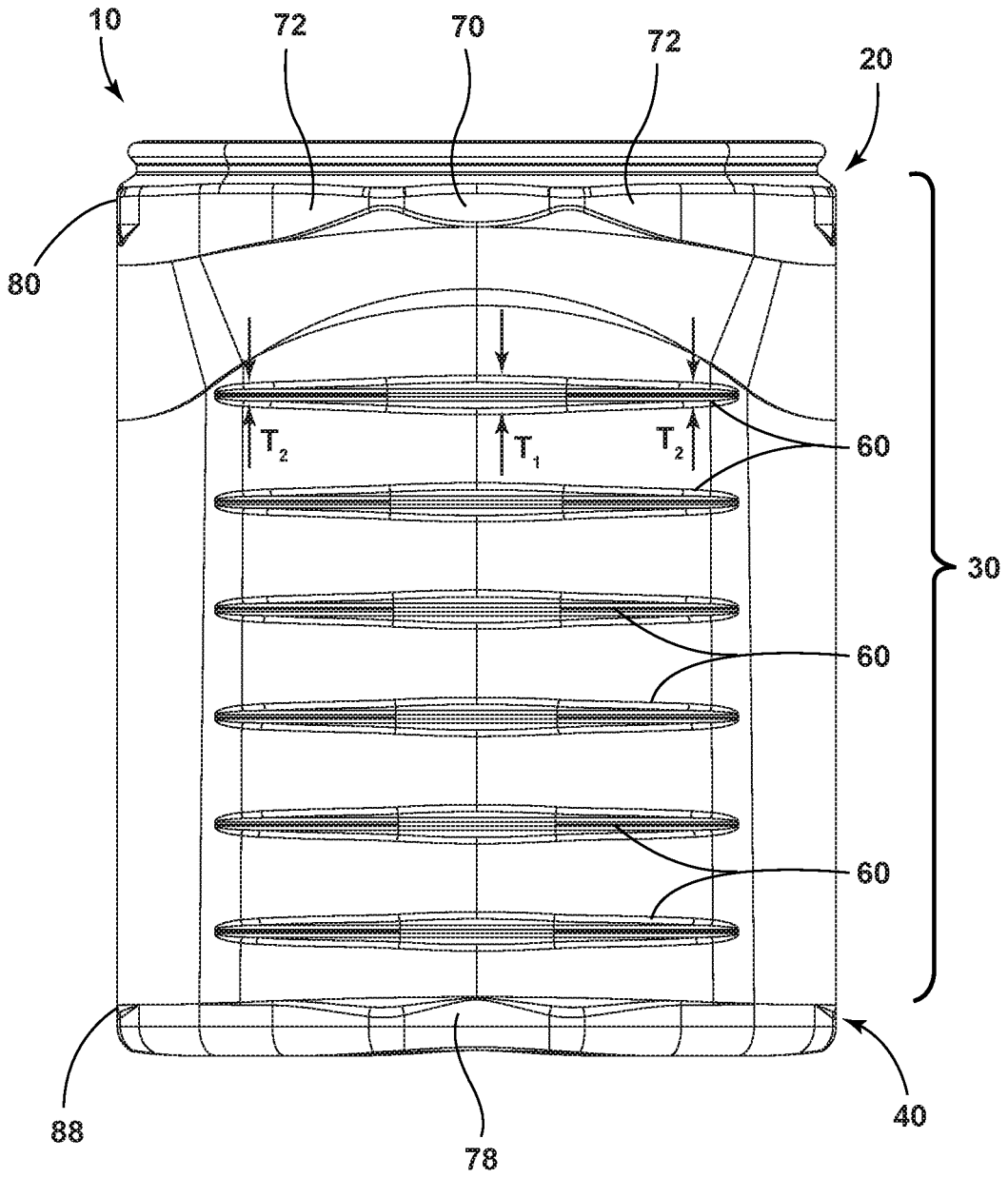
FIG. 13 is a front elevation view of the container illustrated in FIG. 11.
Figure 14:
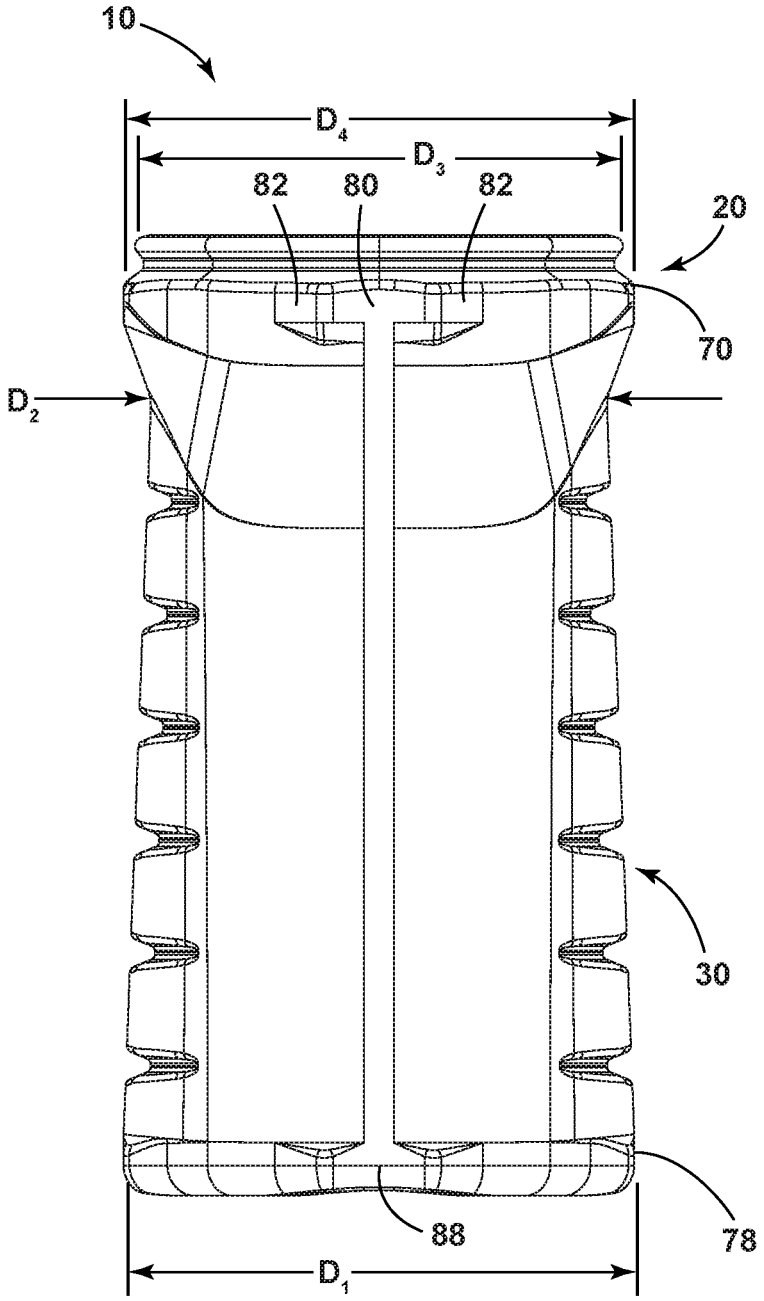
FIG. 14 is a side elevation view of the container illustrated in FIG. 11.
Figure 15:
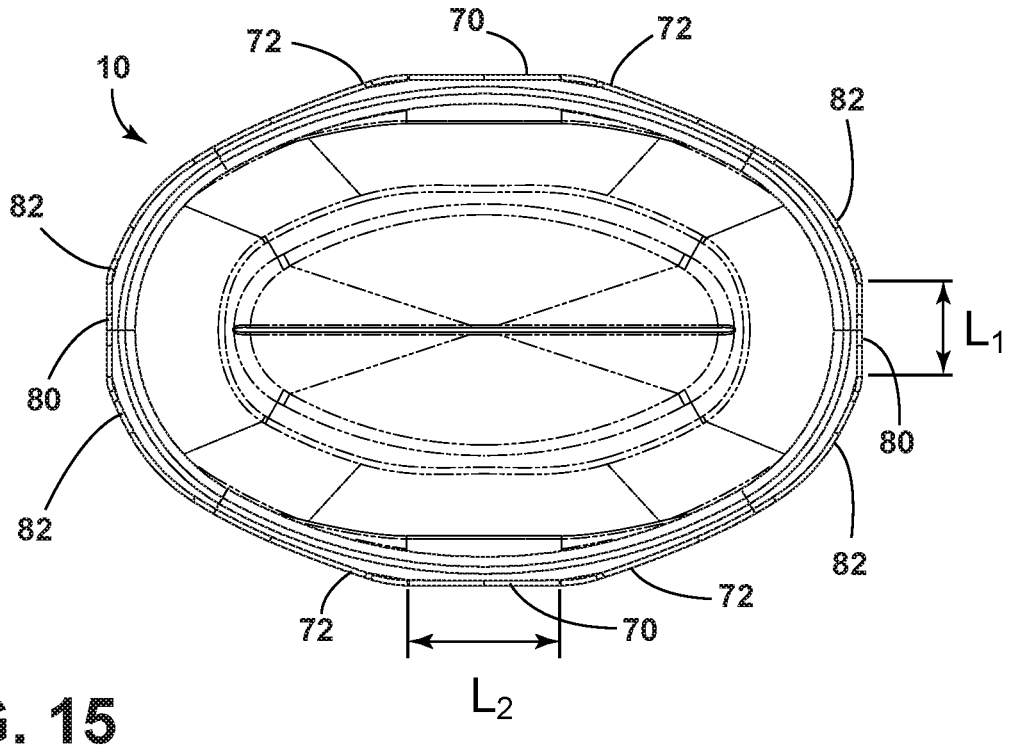
FIG. 15 is a top plan view of the container illustrated in FIG. 11.
Figure 16:
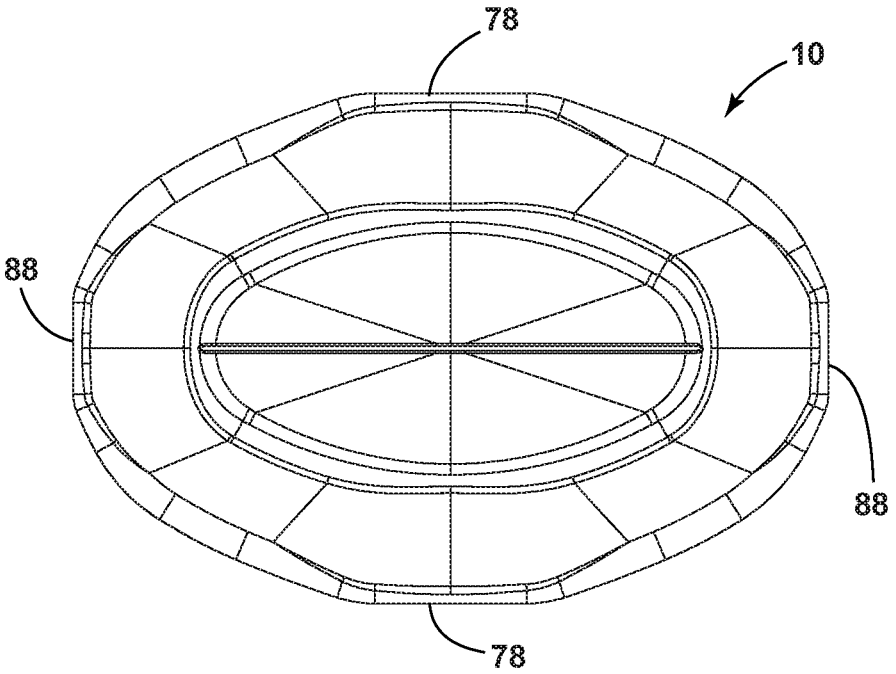
FIG. 16 is a bottom view of the container illustrated in FIG. 11.
Figure 17:
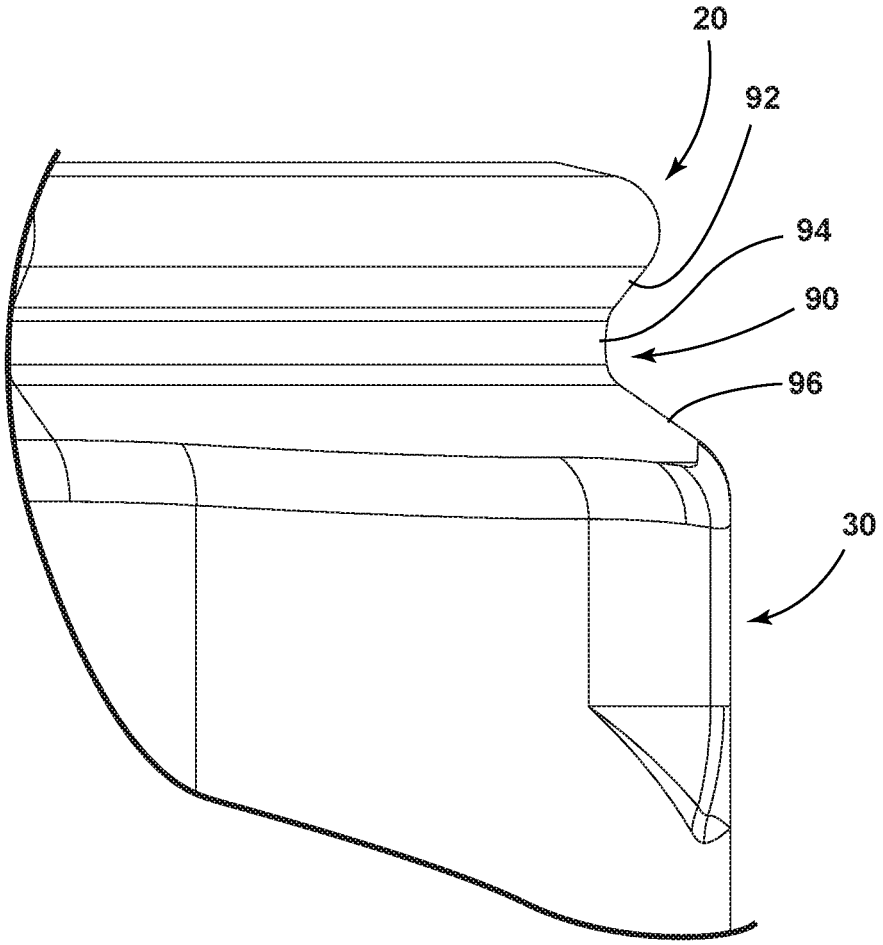
FIG. 17 is an enlarged view of a portion of the container indicated in FIG. 11.

For example, in the configuration shown with the depicted container orientations, as generally illustrated in FIG. 10A, a container in a row at $R_1$,$C_1$ may have side view flat(s) 80 and/or 88 contact or abut similar corresponding flat(s) in a container at $R_1$, $C_2$. Likewise, a container at $R_1$, $C_2$ may have side view flat(s) 80 and/or 88 contact or abut similar corresponding flat(s) in a container at $R_1$, $C_3$. Similarly, as generally illustrated in FIG. 10B, when viewing two rows from the side, a container at $R_1$, $C_1$ may have front view flat(s) 70 and/or 78 contact or abut similar corresponding flat(s) in a container at $R_2$, $C_1$. Such a flat(s)-to-flat(s) configuration can improve, for example, the stability of the configuration in view of an application of various forces, such as those that may be encountered with handling or transport.

It is noted that various embodiments are described herein to various apparatuses, systems, and/or methods. Numerous specific details are set forth to provide an understanding of the overall structure, function, manufacture, and/or use of the embodiments as described in the specification and illustrated in accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "embodiments," "one embodiment," or "an embodiment," or the like, means that a particular feature, structure, or characteristic described in connection with the embodiment is included in at least one embodiment. Thus, appearances of the phrases "in various embodiments," "in embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Any joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present teachings not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A non-round plastic container comprising:

an upper portion with a non-circular opening;

a sidewall portion extending downwardly from the upper portion, the sidewall portion having a front surface, a rear surface, and opposing side surfaces disposed between the front surface and the rear surface;

a base portion extending downwardly from the sidewall portion;

wherein, in an upper portion of the sidewall portion, (i) the front surface and the rear surface and (ii) the opposing side surfaces, each includes a flat provided at about a midlength for each side, viewed from a top plan view, that is configured to contact a flat on an opposing surface associated with a similar container; and, in a top view, the flat of each of the opposing side surfaces is perpendicular to the flat of the front surface and the flat of the rear surface, and the flat of the opposing side surfaces are parallel to each other, wherein each flat is provided at an outermost extending position on the respective surface and is configured to be a first contact point with the flat on the opposing surface associated with the similar container;

wherein the front surface and the rear surface each further includes a lower flat in the base portion, the lower flat being spaced apart from the flat in the upper portion; and wherein the opposing side surfaces each further includes a lower flat in the base portion.

2. The plastic container of claim 1, wherein the plastic container has a substantially oval or ovaloid shape.

3. The plastic container of claim 1, wherein the opening has an oval or ovaloid shape.

4. The plastic container of claim 1, wherein each flat is provided below and radially offset from the opening of the container.

5. The plastic container of claim 1, wherein the sidewall portion of the plastic container has a curved or shaped contour.

6. The plastic container of claim 5, wherein the curved or shaped contour is configured to facilitate gripping.

7. The plastic container of claim 1, wherein the sidewall portion includes a tapered portion at a position below the upper portion that tapers inwardly.

8. The plastic container of claim 7, wherein at or about a vertical mid-point of the sidewall portion, the sidewall portion tapers outwardly toward the base portion.

9. The plastic container of claim 1, wherein the sidewall portion includes one or more reinforcing formations.

10. The plastic container of claim 9, wherein the one or more reinforcing formations comprise one or more horizontally extending ribs.

11. The plastic container of claim 9, wherein the one or more reinforcing formations have varying vertical dimensions.

12. The plastic container of claim 1, wherein the sidewall portion includes one or more horizontally extending ribs that extend inwardly, the one or more horizontally extending rib has a vertical thickness at or about a centerline or middle position of the horizontally extending rib, and the vertical thickness tapers in a direction towards each end of the horizontally extending rib.

13. The plastic container of claim 12, wherein the vertical thickness at or about a centerline or middle position of the horizontally extending rib is at least about twice the vertical thickness at or about the end of the horizontally extending rib.

14. The plastic container of claim 1, wherein the plastic container has a horizontal dimension that varies at different vertical positions.

15. The plastic container of claim 1, wherein, viewed in top plan, the flat of the opposing side surfaces has a length that is greater than the length of the flat of the front surface and the length of the flat of the rear surface.

16. The plastic container of claim 1, wherein the flat is provided at an outermost extending position and is configured to be a first vertical plane in contact with an identical container.

17. The plastic container of claim 1, wherein the upper portion includes an annular band or ring that transitions into the sidewall portion.

18. The plastic container of claim 1, wherein the plastic container is formed by extrusion molding or extrusion blow molding.

19. The plastic container of claim 17, wherein the band or ring includes an upper angled segment, a substantially vertical segment, and a lower angled segment, wherein the substantially vertical segment is disposed axially between the upper and lower angled segments.

* * * * *